US005299877A

United States Patent [19]

Birden

[11] Patent Number: 5,299,877

[45] Date of Patent: Apr. 5, 1994

[54] LIQUID APPLICATOR

[76] Inventor: Donald Birden, 444 N. Lamon, Chicago, Ill. 60644-2027

[21] Appl. No.: 12,920

[22] Filed: Feb. 3, 1993

Related U.S. Application Data

[63] Continuation-in-part of Ser. No. 798,148, Nov. 26, 1991, abandoned.

[51] Int. Cl.[5] ..... B05C 17/00

[52] U.S. Cl. ..... 401/206; 401/196; 401/207

[58] Field of Search ..... 401/204–207, 401/186, 196, 23

[56] References Cited

U.S. PATENT DOCUMENTS

| | | | |
|---|---|---|---|
| 2,281,367 | 4/1942 | Moll . | |
| 2,314,394 | 3/1943 | Guy | 401/206 |
| 2,820,234 | 1/1958 | Rigney . | |
| 3,148,401 | 9/1964 | Gilchrist et al. . | |
| 3,418,055 | 12/1968 | Schwartzman . | |
| 4,104,435 | 8/1978 | Ballesteros . | |
| 4,201,491 | 5/1980 | Kohler . | |
| 4,693,623 | 9/1987 | Schwartzman . | |
| 4,925,327 | 5/1990 | Wirt . | |

OTHER PUBLICATIONS

Technical Data Sheet Stephenson & Lawyer, Inc. (2 pages) SIG Felt Permanently Compressed Reticulated Foam (SIF) . . .

Technical Data Sheet Stephenson & Lawyer, Inc. (4 pages) SIF Flexible Porous Cellular Plastic.

Folder (5 pages) and insert (4 pages) Stephenson & Lawyer, Inc. Foam materials.

*Primary Examiner*—Danton D. DeMille

*Attorney, Agent, or Firm*—Clyde I. Coughenour

[57] ABSTRACT

An applicator for coating materials, such as shoe polish, is made with a relatively rigid open cell foam coating pad. The foam has an average of from 12 to 25 pores per linear centimeter with an average pore size being from 0.4 to 2 microns. The pad rigidity can be provided by a hard material per se or by having a flexible porous foam material compressed from its original volume to from 1/10th to 1/20th its original volume. The coating pad has less than a 20% compression when subjected to a 400 gm/cm$^2$ pressure. The coating pad can be used with a pigmented coating material or polish with an average particle size of from 0.4 to 1 micron.

20 Claims, 1 Drawing Sheet

FIG. 1
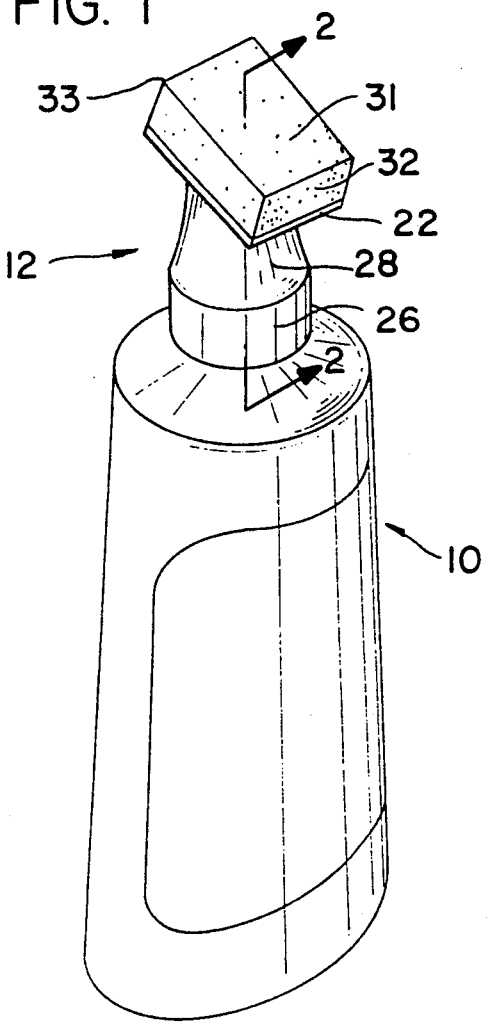
FIG. 2
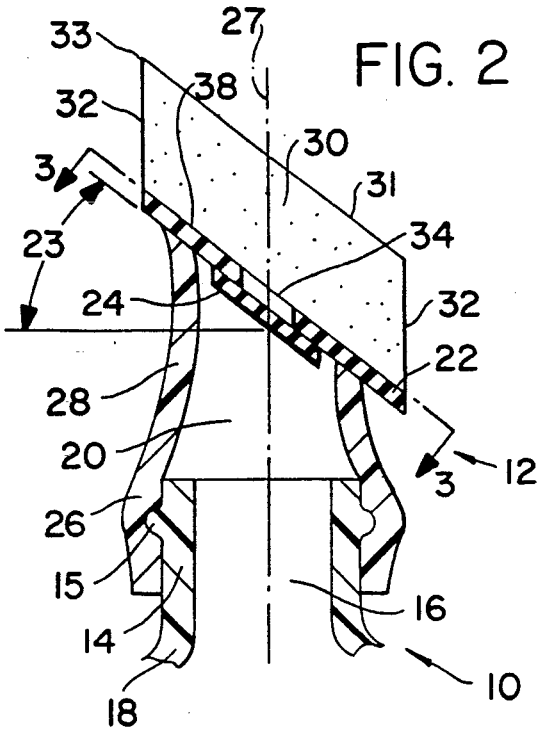
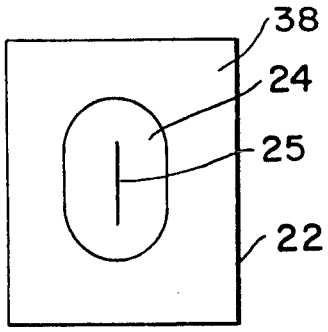
FIG. 3
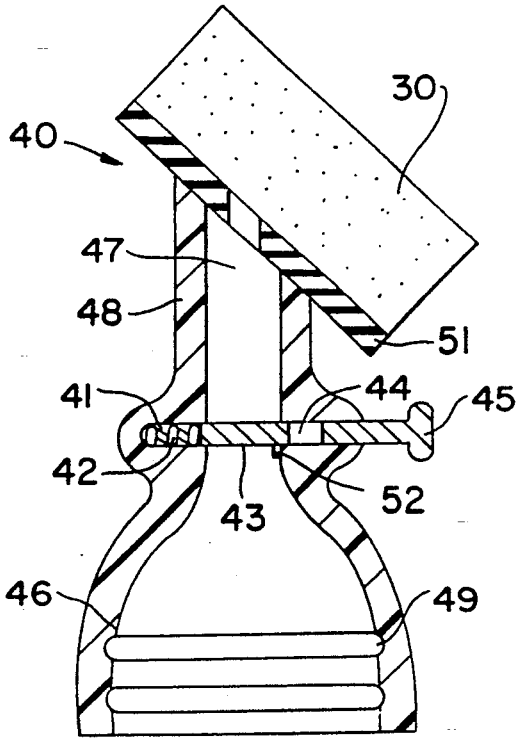
FIG. 4

LIQUID APPLICATOR

CROSS-REFERENCE

This application is a Continuation-in-Part of applicant's prior application, Ser. No. 07/798148 filed Nov. 26, 1991 now abandoned.

BACKGROUND OF THE INVENTION

1. Field of the Invention

This invention relates to coating applicators, such as for the application of polish to shoes. The applicator has a shape retentive open pore wicking pad for controllably transferring fluid coating material to the surface of an object to be coated. Because of the relative stability of the pad, small or narrow areas can be coated even though they are adjacent areas that are not to be coated or that are of different colors.

2. Description of Related Art

Present coating applicators, such as shoe polish applicators, are designed for the care of shoes that are of one color. They are designed to yield so that curved surfaces and hard to reach areas can be contacted by the readily deformable wicking pad. The applicator of the patent issued 15 Sep. 1964 to J. R. Gilchrist et al., U.S. Pat. No. 3,148,401, is representative of the type that have a soft, readily deformable foam or fabric pad for wicking the liquid polish from a supply container and spreading the polish onto a surface such as a shoe. The pads are generally made of a polyurethane or other sponge with a large open cell configuration or of a felt material. When pressed against a shoe to release the polish, the pad surface engages the shoe and deforms so that its shape and dimensions are significantly altered to conform to the shape of the surface area being coated.

A problem with liquid applicators using soft foam wicking application pads is that the compacted foam often becomes so thin that its wicking characteristics are significantly altered; the compressed foam often becomes permanently compacted; and as the liquid of the polish dries and solidifies in the pad, the pad becomes a hardened mass that is incapable of conforming to the contours of the shoe. Frequently, on hardening, the pad clogs and will no longer permit the passage of the coating material or polish. Another problem is that soft foam is prone to being worn or scraped off during use. This usually results in an uneven application or puddling of the coating on the surface. When multicolor shoes or other surfaces with irregular patterns are coated, adjacent surface areas are routinely inadvertently coated also.

U.S. Pat. No. 4,925,327, issued 15 May 1990 to D. Wirt, teaches a liquid applicator with a supply and open cell elastomer foam sponge. The foam is given a permanent compression set with a reduction in its original volume of from 1.5 to 10. A reduction in volume of ½ to ¼ its original volume is preferred. The sponge has from 10 to 100 pores per linear inch with 90 pores per inch preferred. A layer of porous unfoamed material is used to meter the liquid from the supply to the sponge applicator. The combination is designed or selected so that the liquid will wet but not drip, the storage capacity (density) of the sponge will be regulated to hold the amount of liquid to be dispensed, and to control or adjust the viscosity and the surface tension of the liquid to be dispensed.

The standard open cell pad, such as used by KIWI $_{T.}$ and Gilchrist et al (U.S. Pat. No. 3,248,401), have a coating surface area of essentially 5 $cm^2$ and a thickness of essentially ¾ cm. A pressure of 2,000 gms applied uniformly over the 5 $cm^2$ surface area will compress this standard foam pad to about ½ its original thickness. Using the common type foam applicator, a pressure of up to 19 grams on a corner of the pad produces a line of 3 mm, and 23 to 25 grams produces a line of 5 mm, and 140 to 155 gms produces a line of 15 mm in width. The slit valve is normally opened with a force of between 2,500 to 3,200 gms on the applicator.

There has been a general assumption that large pores were necessary to conduct the coating, and in particular a pigment containing coating material, through a porous applicator pad. Even with the use of large pores, there has been a problem with the pads hardening and preventing the free flow of the coating material through the pad.

SUMMARY OF THE INVENTION

The principal objective of the present invention is to accurately control the application of the liquid or coating fluid. This is accomplished by providing a coating pad with relatively small open pores that does not significantly deform when pressed against a surface to be coated or polished. The applicator, and in particular a corner of the pad, can be used in a manner similar to that of a capillary marking pen.

The applicator has a coating pad of predetermined thickness and rigidity or firmness which is sufficiently resistent to deformation that the pad thickness is not significantly altered as the pad surface is placed on and forced against a surface to be coated. The applicator pad can be made completely or partially from a relatively rigid foam material or can be a compressed reticulated foam. The foam can, for example, be an open pore flexible ester polyurethane foam with a controlled foam pore size and firmness. Because the pad does not significantly deform, the coating can be controlled both as to the amount of material applied and the location where the material is applied to. As one example, a narrow strip of material can be coated without application of the coating material to adjacent areas.

The trend for application of coatings that contain solid pigments has been to use pad applicators that are resilient with large pores. It has been discovered that by using a coating material with reasonably controlled particle size and pad pore size, with a minimum clearance between the particles and pores, the coating can be applied by capillary action similar to that used for liquid transfer in pens and other implements. In addition, by making the pad rigid, the applicator maintains the pore size, even under normal use pressures, and maintains uniform coating characteristics that are similar to those of pens.

The relatively rigid open pore pad provides for a relatively constant cross-section passage from the container to the coating surface. The control of the pore size forming the passages provides for capillary flow of the coating material through the pad and provides a controllable ratio between particles in the coating fluid and passage cross-section and also provides a metering and almost constant flow of coating material through the pad without the need for a separate or additional metering means. Even with the pad bending at its corner, to provide different width coatings, the flow of coating material remains essentially constant because of the non-compressible nature of the pad.

Because of the relatively constant small cross-section through the pad, the response time required for the coating material to travel through the pad depends on the pad thickness. The thinner the pad, the less time required for travel through the pad and the more the pad is subjected to bending. The amount of bending of the pad can be controlled in part by the thickness and/or hardness or resistance to bending of the mounting block that supports the back edges of the pad.

When using an applicator with a slit valve, sufficient force deforms the membrane and opens the slit valve to effect migration of fluid from the supply into the porous pad. This may be done before or during the coating operation as the pad holds a modest amount of coating material. As alternatives, a spring loaded gate valve or other control means can be used to dispense coating material from the supply to the porous pad. The liquid applicator can be independent or have a holding means within its body structure, such as a cylindrical sleeve for embracing a container. The sleeve can have threads for engaging threads on a container or can be flexible for a frictional fit within or over the neck of a container. For example, the applicator can be used in combination with a liquid container having an annular rim by resiliently and frictionally engaging the cylindrical body sleeve of the applicator over the annular rim of the container.

In one use of the invention, the polishing liquid in the container can include a pigment. One composition that can be used is acrylic copolymer D, hydroxy, alcohol, organic amine neutralizer, titanium dioxide pigment and water. For use with such a pigmented coating material, the pad must have pores with a diameter large enough to facilitate passage of the pigments and liquid therethrough.

BRIEF DESCRIPTION OF THE DRAWINGS

FIG. 1 is a perspective view of a liquid container mounting the improved liquid applicator of the present invention.

FIG. 2 is a fragmentary cross-sectional view taken along line 2—2 of FIG. 1 showing a portion of the liquid applicator.

FIG. 3 is a cross-sectional view taken along line 3—3 of FIG. 2 showing a slit valve used in the liquid applicator.

FIG. 4 is a cross-sectional view of a spring loaded gate valve used in the liquid applicator.

DETAILED DESCRIPTION OF THE PREFERRED EMBODIMENT

FIGS. 1-3 show a container 10, for holding a supply of coating material, with an applicator 12 secured to the container. The container has a body 18 with a neck 14 and a passage 16 through which liquid is admitted to and discharged from the container 10. An annular rim 15 surrounds and is a part of the neck 14. The applicator body 12 has a cylindrical flexible sleeve 26, which can be slightly smaller than the annular rim 15 and even the neck 14, so as to resiliently and frictionally embrace the annular rim 15 and, if desired, the hollow neck 14. The sleeve 26 and extension 28 are made of flexible plastic or rubber that defines an internal fluid passageway 20. The passageway 20 of the applicator receives coating fluid from the passage 16 in the neck 14 of the container.

Integral with or attached to the sleeve extension 28 is a mounting block 22. The block 22 is impervious to the coating material with a centrally located control membrane 24 integral with or attached to it. A slit 25 is formed in the center of the membrane 24. The slit 25 is normally closed to keep the container 10 sealed but opens, forming a fluid outlet, if the membrane 24 is twisted and deformed as by the application of a bending force to the applicator sleeve and extension. The bending force can be caused by pressing the applicator against a surface, such as the surface to be coated. The membrane 24 and slit 25 provide a sealable communicative path between the container 10, applicator 12, and open pore coating pad 30 of the applicator.

A pad mounting surface 38 of the mounting block 22 faces outwardly. The surface 38 is generally rectangular, and is aligned at an acute angle 23 to a line perpendicular with the axis 27 of the container neck 14 and sleeve extension 28. The membrane can present any desired shape to the pad 30 through the block 22. Shown in FIG. 3, the slit 25 in membrane 24 aligns with the major axis of an elliptical opening in the mounting block 22.

FIG. 4 shows an applicator 40, similar to that 12 of FIG. 3, With a gate type valve 43 replacing the slit valve. This embodiment permits a mounting block 51 for the pad 30 to be anywhere from resilient to rigid. The gate valve 43 has an operating knob 45 that can be pressed against the pressure of a spring 42 in a slot 41. A stop pin 52 retains the gate valve within the passage 47. By pressing and moving the valve against the spring 42 the aperture 44 in the valve 43 is shifted to align with the passageway 47 in the sleeve extension 48 to conduct the coating material from a container to the pad 30. The sleeve 46 is provided with threads 49 for attachment to a container (not shown).

In operation, the container 10 is inverted, filling the passageway 20 with the coating material or fluid to be applied to the surface. As long as no pressure is applied to the neck 18, slit 26 in membrane 24 remains closed. When the surface 31 of the pad 30 is pushed against a surface with a predetermined force or otherwise twisted, the neck 28 bends, causing the block 22 and membrane 24 to distort and open the slit valve. The liquid then flows from the passageway 20 into contact with the back 34 of pad 30. The liquid wicks through pad 30 to the surface 31 thereof. The membrane 24 thereby is used to meter coating fluid to the pad 30. The slit may be opened by distortion of the flexible neck either before or during the coating application. The flow rate of the fluid coating through the slit and between the slit, or other valve means, and the pad surface 31, is determined by the size of the valve opening and the physical characteristics of the pad material and coating fluid. If a dye material is used, the capillary attraction or adhesive attraction between the coating material and pad material is of primary importance. If a pigment is included in the coating fluid, the size of the pigments and passage openings within the pad become a primary consideration. Depending on the coating material and the coating thickness or amount of coating material to be used, the duration or time the slit or other valve is open to deliver coating material to the pad may be controlled. For a given coating and pad material and pad thickness, the time required for the coating material to progress from the valve means to the pad surface 31 varies. For optimum performance, the rigidity of the pad, the pore size of the pad and the coating material must be coordinated.

An important aspect of the present invention is the pore size of the applicator pad and the pore size relationship to the coating material, and in particular the particle size of any pigments used in the coating material. Surprisingly, it has been found that if a capillary relationship is maintained between the pore size and coating material, not only are desirable coating characteristics provided, but even the dreaded dryout and hardening or blockage occurring during non-use of the applicator is overcome to some degree. While not fully understood, it is believed that drying out is retarded or that the capillary action assists in liquid contact and rewetting of the particles that, because of the close tolerances between the pore or opening size and particles, does not permit the particles and dried coating material to form an aggregate or large rigid body of particles bonded together by the coating material that is intended to be formed on the surface to be coated.

The pad 30 can be made of compressed, reticulated "open pore" flexible ester type polyurethane foam. The pad 30 must have pores of sufficient size to allow the polish to properly wick. If the pores are too small, the polish will clog up the pores of the pad, stop the migration of the polish through the pad 30, and prevent it from reaching the outer surface 31 of the pad. On the other hand, if the pores are too large, the polish will flow too quickly through the pad or will not flow by capillary attraction. Large pores tend to reduce the firmness of the pad 30. It is necessary to select a pore size particularly suited for the coating material or polish used.

To provide the capillary action desired, it has been found that the cell size should be from 0.4 to 2 microns with particles having an average diameter of from 0.4 to 1 micron and a frequency of from 12 to 25 cells per linear cm. The preferred particles are those with an average size of 0.5 microns with cell sizes that range from 0.5 to 1.8 microns and an average frequency of from 20 to 22 cells per linear cm.

Another important aspect of the present applicator pad is the rigidity or firmness of the pad. The firmer the pad, the less it will compress under the forces or pressures applied during use. Because of the close tolerances between the particle sizes of the coating material and the pore openings of the pad, significant compression of the pad during use would close or reduce the size of the passages provided by the pores and restrict the flow of the particles. Additionally, any significant compression of the pad, when a corner is used to coat a narrow area or line, will cause the area of the pad in contact with the surface to be coated to be broader and harder to control. The pad 30 must have sufficient firmness so that edges 32 do not significantly deflect or compress when a pressure is applied. With the relatively firm pad of the invention, a corner 33 may be used to form a narrow coating and/or form a coating on a curved surface area similar to that which can be formed by a pen.

The rigidity of the pad can be controlled by proper selection of materials and pore size and distribution. The coating pad of the present invention should not have a compression of greater than 20% with an applied pressure or force of 400 gm/cm$^2$. Preferably the compression should be less than 10%. Rather than just using an inherently rigid material, a flexible material with a permanent compression set can be used. As an example, the applicator pad of the present invention can have a compression ratio of 10 to 20:1 or can be compressed from 10 to 20 times from its original volume. This means that the pad has a thickness or volume reduced to from 1/10th to 1/20th of its original volume to provide the desired rigidity. The preferred pad has a compression ratio of from 14 to 18. That is, the coating pad has a permanent compression set that is from 1/14th to 1/18th its original volume.

One example of a specific foam that may be used is SIF Felt®, a trade name, manufactured by Foamex, a division of Knoll International Holdings, Inc., a corporation of Eddystone, Pa. The advantage of using SIF Felt® is that the pore size can be selected and controlled during the manufacturing process. The use of the SIF Felt® allows the selection of a pore size, tailored to the fluid or coating material to be applied to a surface, and the firmness of the pad. The material is a flexible, compressed urethane foam made from a reticulated polyester or polyether polyurethane open-pore foam. By selecting the amount or degree the original foam is compressed, the firmness of the resulting foam can be controlled. The firmness of an originally resilient material, from a compression and set of from 1½ to 20 times the original volume, results in a foam product that ranges from soft and flexible to rigid. Thus, it is possible to maximize the wicking capabilities of the pad and minimize the susceptibility of the pad to clogging while maintaining the firmness desired for the particular coating material and surface or area to be coated.

An acceptable porous foam pad with the desired characteristics was determined. To find the particle and cell size the pad was observed under an electron microscope and was mounted, vacuum sputtered with a thin film of gold, and then examined under a Broutman's Cambridge 360 Stereoscan SEM. The pad was photographed and the cell size measured using the line SEM images and measurement cursors. The preferred pad was shown to have 12 to 25 cells per linear centimeter with an average of from 20 to 23. The maximum number of cells per centimeter was about 25 and the minimum was about 10 with an average cell size of from 0.5 to 0.8 microns. As an example, a preferred white shoe polish, composed of acrylic copolymer D, hydroxy, alcohol, organic amine neutralizer, titanium dioxide pigment and water, with an average pigment size of about 0.5 microns was used.

A porous pad 30 having essentially the same surface dimensions as the mounting surface 38, and having a thickness of between 0.1 to 1.5 cm with 0.2 to 1 cm is preferred. The pad 30 can be formed in place on the mounting block or can be attached to the surface 38, such as by an adhesive. With the applicator of the present invention, a 1 mm width line can be drawn with a force of up to 19 gms on one corner of the pad. A 2 mm line can be drawn with a force of 21 to 25 gms and a 3 mm line with a force of 125 to 150 gms. When used, the slit valve begins to open at a force of about 2,500 gm with a maximum opening at about 3,200 gm. The pad 30 is sufficiently rigid that the force applied to the pad surface 31 does not significantly alter the predetermined shape, surface area, and thickness of the pad 30. The pad can be made as large or small as desired and dimensions as small as 0.5 cm in width and length have been found satisfactory.

By controlling the rigidity of the block 22, the amount of force necessary to open the slit of the membrane can be controlled. The rigidity of the block 22 also has an affect on the amount of deflection any given force has on the pad. If the block 22 yields, the pad can bend in response to a pressing force. The resistance to deflection of the pad restricts the ease with which a force deforms the sleeve extension and block for opening the valve means, and for permitting passage of fluid through the slit. By selecting an appropriate pad and block combination, the force on the pad necessary to open the valve can be selected as well as the amount of valve opening and amount of coating fluid provided to the coated surface. If desired, the slit can be opened only to provide coating fluid flow to the pad before coating begins. Any manually valve may be used as a substitute for the slit membrane shown, as a fluid flow control.

Using a 5 $cm^2$ area and a ¾ cm thick pad with the pad compressed to 1/16th of its original volume, a pressure of 2,000 gm applied uniformly over the 5 $cm^2$ surface area has no visibly noticeable compression. With a ½ cm thick pad, a 0.2 to 0.5 cm thick mounting block backing having a Shore A durometer hardness of 50 to 70 provides a desirable support. As the thickness of the pad is reduced, to prevent excess bending, the thickness and/or hardness of the support mounting block must be increased to provide the best control of the coating width onto the surface to be coated.

With the average pigment size of about 0.5 micron and an average pore size of from 0.5 to 0.8 micron, it takes about 30 seconds for the coating material to travel from the valve means through the pad to surface 31 with a pad thickness of 0.75 cm. By reducing the pad thickness and increasing the support block thickness or hardness the same coating characteristics can be maintained with a reduced waiting time. Because of the rigidity and wear characteristics of the selected and preferred SIF Foam ® material, a thin pad can be used repeatedly without noticeable wear or interference to coating material flow.

It is believed that the construction, operation and advantages of this device will be apparent to those skilled in the art. It is to be understood that the present disclosure is illustrative only and that changes, variations, substitutions, modifications and equivalents will be readily apparent to one skilled in the art and that such may be made without departing from the spirit of the invention as defined by the following claims.

I claim:

1. An applicator for a fluid coating material comprising:

a coating pad for metering said coating material onto a surface;

a support for said coating pad;

a passageway within said support for conducting said coating material to said coating pad;

said coating pad being an open pore foam having an average number of pores from 12 to 25 per linear centimeter with the average pore size being from 0.4 to 2 microns and with a pad rigidity such that a 400 gm/$cm^2$ causes a compression of less than 20%

2. An applicator for a fluid coating material as described in claim 1 wherein:

said coating pad is a resilient reticulated foam that has been made firm by compressing it to less than 1/10th of its original uncompressed volume.

3. An applicator for a fluid coating material as described in claim 1 wherein:

said coating pad is a compressed reticulated polyurethane open pore foam.

4. An applicator for a fluid coating material as described in claim 1 wherein:

said coating pad is a reticulated polyurethane open pore foam compressed to less than 1/14th of its original uncompressed volume.

5. An applicator for a fluid coating material as described in claim 1 wherein:

said coating pad has an average number of said pores of from 18 to 23 per linear cm and an average said pore size of from 0.5 to 1.8 microns.

6. An applicator for a fluid coating material as described in claim 5 wherein:

said coating pad is a reticulated polyurethane open pore foam compressed to less than 1/14th of its original uncompressed volume and has a rigidity such that a 400 gm/$cm^2$ causes a compression of less than 10%.

7. An applicator for a fluid coating material as described in claim 1 wherein:

said coating pad has a thickness of from 0.1 to 1.5 cm and said support is a resilient material with a Shore A durometer hardness of between 50 and 70.

8. An applicator for a fluid coating material as described in claim 7 wherein:

said support includes a slit valve that is deformed to provide a fluid flow path to said coating pad.

9. An applicator for a fluid coating material as described in claim 7 wherein:

said support includes a gate valve that is moved against spring pressure to provide a fluid flow path to said coating pad.

10. An applicator for a fluid coating material as described in claim 7 wherein:

said support for said coating pad includes a mounting block;

a sleeve extension is attached to said mounting block;

said mounting block is attached to said sleeve extension such that said mounting block forms an acute angle with a perpendicular line drawn to a center line drawn through said sleeve extension.

11. An applicator for a fluid coating material as described in claim 10 wherein:

said mounting block has a Shore A durometer hardness of between 50 and 70 and a thickness of between 0.2 and 0.5 cm and is attached to said coating pad around the outer periphery of said coating pad.

12. An applicator for a fluid coating material as described in claim 1 in combination with a fluid wherein:

said applicator includes a container;

said container is attached to said support for conducting said coating material to said passageway;

said fluid coating material is disposed within said container;

said coating material is a fluid that contains solid pigments that have an average particle size between 0.4 and 1 micron.

13. An applicator for a fluid coating material as described in claim 12 in combination with a fluid wherein:

said coating material consists of an acrylic copolymer D, hydroxy, alcohol, organic amine neutralizer, titanium dioxide pigments and water.

14. An applicator for a fluid coating material as described in claim 13 in combination with a fluid wherein:

said average particle size is between 0.4 and 0.8 microns;

said coating pad is a resilient reticulated foam that has been made firm by compressing it to less than 1/10th of its original uncompressed volume;

said coating pad has an average number of said pores from 18 to 23 per linear cm and an average said pore size of from 0.5 to 1.8 microns.

15. An applicator for a fluid coating material as described in claim 12 in combination with a fluid wherein:

said average particle size is 0.5 microns and said average pore size is from 0.5 to 0.8 microns.

16. An applicator for a fluid coating material as described in claim 15 in combination with a fluid wherein:

said coating material consists of an acrylic copolymer D, hydroxy, alcohol, organic amine neutralizer, titanium dioxide pigments and water.

17. An applicator for a fluid coating material as described in claim 16 in combination with a fluid wherein:

said support for said coating pad includes a mounting block;

a sleeve extension is attached to said mounting block;

said mounting block is attached to said sleeve extension such that said mounting block forms an acute angle with a perpendicular line drawn to a center line drawn through said sleeve extension said mounting block has a Shore A durometer hardness of between 50 and 70 and a thickness of between 0.2 and 0.5 cm and is attached to said coating pad around the outer periphery of said coating pad.

18. An applicator for a fluid coating material as described in claim 13 in combination with a fluid wherein:

said coating pad is a reticulated polyurethane open pore foam compressed to less than 1/14th of its original uncompressed volume;

said coating pad has an average number of said pores from 18 to 23 per linear cm and an average said pore size of from 0.5 to 1.8 microns;

said coating pad has a thickness of from 0.1 to 1.5 cm and said support is a resilient material with a Shore A durometer hardness of between 50 and 70.

19. An applicator for a fluid coating material as described in claim 16 in combination with a fluid wherein:

said support includes a membrane having a slit valve that is deformed to provide a fluid flow path to said coating pad.

20. An applicator for a fluid coating material as described in claim 16 in combination with a fluid wherein:

said support includes a gate valve that is moved against spring pressure to provide a fluid flow path to said coating pad.

* * * * *